US010253503B2

(12) United States Patent
Greenberg

(10) Patent No.: US 10,253,503 B2
(45) Date of Patent: Apr. 9, 2019

(54) WATERFALL GUTTER SYSTEM

(71) Applicant: James Greenberg, Staatsburg, NY (US)

(72) Inventor: James Greenberg, Staatsburg, NY (US)

( * ) Notice: Subject to any disclaimer, the term of this patent is extended or adjusted under 35 U.S.C. 154(b) by 0 days.

(21) Appl. No.: 15/053,245

(22) Filed: Feb. 25, 2016

(65) Prior Publication Data

US 2017/0247887 A1 Aug. 31, 2017

(51) Int. Cl.
*E04D 13/064* (2006.01)
*E04D 13/076* (2006.01)

(52) U.S. Cl.
CPC ..... *E04D 13/0645* (2013.01); *E04D 13/0641* (2013.01); *E04D 13/076* (2013.01)

(58) Field of Classification Search
CPC ..... E04D 13/0645; E04D 13/0641
See application file for complete search history.

(56) References Cited

U.S. PATENT DOCUMENTS 2,494,780 A * 1/1950 Schmidt ..... E04D 13/0645 210/162
3,465,885 A * 9/1969 Trump ..... E04D 13/08 210/447
3,481,366 A * 12/1969 Mortonson ..... E04D 13/08 137/873
4,470,908 A * 9/1984 Odekirk ..... B01D 35/00 210/463
4,615,153 A * 10/1986 Carey ..... E04D 13/0645 210/162
4,798,028 A 1/1989 Pinion
4,801,377 A * 1/1989 Bolt ..... B01D 29/035 210/162
4,837,987 A * 6/1989 Fender ..... E04D 13/076 52/11
5,119,849 A * 6/1992 Hinkley ..... E04D 13/08 134/104.1
5,230,798 A * 7/1993 Rogman ..... B01D 29/23 210/447
5,678,360 A * 10/1997 Fort ..... E04D 13/0645 210/474
5,709,051 A * 1/1998 Mazziotti ..... E04D 13/076 210/162
6,219,972 B1 * 4/2001 Zusy ..... E04D 13/0645 137/121
6,263,618 B1 7/2001 Jones
6,497,816 B2 12/2002 Naddy
7,334,369 B2 2/2008 Carson
7,401,571 B1 7/2008 Creed
8,006,720 B1 * 8/2011 Kotansky ..... E04D 13/08 137/873

(Continued)

*Primary Examiner* — Phi D A
*Assistant Examiner* — Omar F Hijaz
(74) *Attorney, Agent, or Firm* — Vincent G. LoTempio; Kloss, Stenger & LoTempio; David T. Stephenson

(57) ABSTRACT

A waterfall gutter system comprises at least one J-shaped rain gutter configured to be attached to edges of a roof wherein mounting hardware is located at an underside of the gutter and a funnel independently attachable at its lower end to a top end of a downspout wherein there is a vertical gap between a top of the funnel and an end of the gutter wherein water can be seen to flow or not flow from the end of the gutter into the top of the funnel from a position of a person standing at ground level.

18 Claims, 3 Drawing Sheets

(56) References Cited

U.S. PATENT DOCUMENTS

| | | | | |
|---|---|---|---|---|
| 8,475,654 | B1 * | 7/2013 | Smith | E04D 13/0767<br>210/162 |
| 8,517,047 | B2 * | 8/2013 | Teoh | E03B 3/03<br>137/357 |
| 8,656,947 | B1 * | 2/2014 | Barton | E04D 13/08<br>137/544 |
| 9,038,320 | B1 * | 5/2015 | Deakins | E04D 13/0767<br>52/12 |
| 2009/0229191 | A1 * | 9/2009 | Petrov | E04D 13/0645<br>52/16 |
| 2012/0210652 | A1 * | 8/2012 | Seitz | E04D 13/08<br>52/12 |
| 2015/0292210 | A1 * | 10/2015 | Haley | E04D 13/0641<br>52/12 |
| 2016/0033086 | A1 * | 2/2016 | Goodsell | F17D 5/02<br>137/15.17 |

* cited by examiner

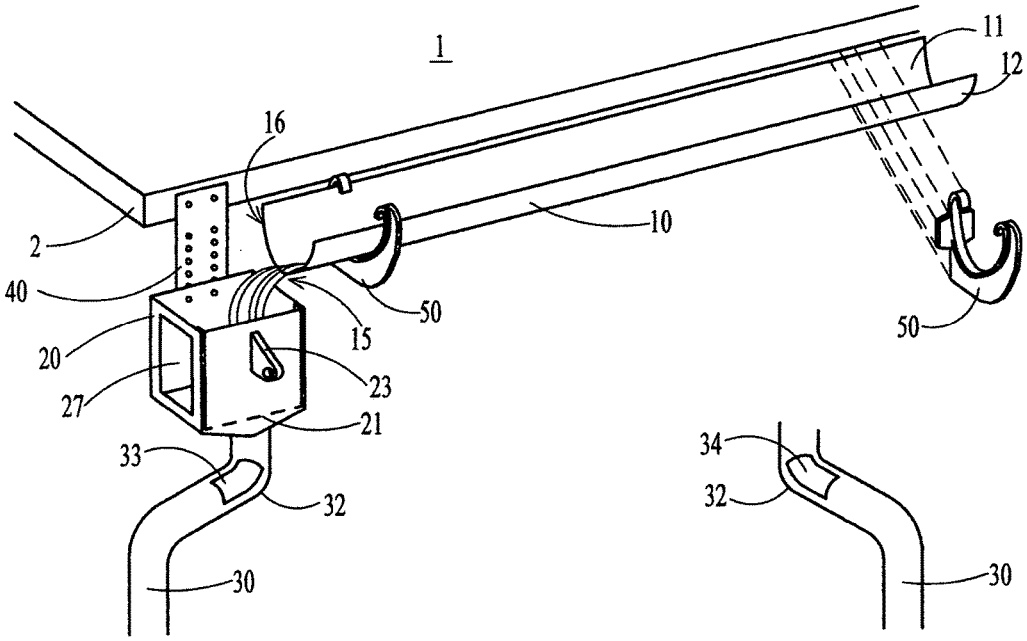
Figure 1
Figure 1A
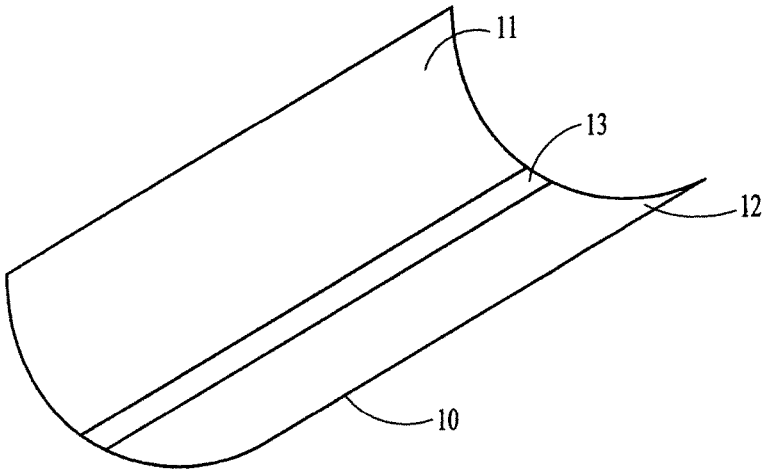
Figure 2

WATERFALL GUTTER SYSTEM

TECHNICAL FIELD

This application relates to the general field of gutter systems, and more particularly, to a gutter system that dramatically reduces debris build up.

BACKGROUND

Present open gutter systems clog easily and quickly, developing blockages that cannot be detected or cleaned from the ground. Gutter cover systems are usually essentially filters which also clog, defeating their intended function. They further do not prevent the build up of organic material inside, but they do make access to the gutter interior very difficult for cleaning or any other purpose, if needed.

There have been numerous attempts to deal with the perennial problem of gutter debris and gutter clogging. Most of the attempts involve some kind of filtration technique. Such techniques do not remove the problems; they merely relocate them. Filters of all types exist for gutter channels as well as specifically for downspouts.

Cleaning devices are also abundant on the market. Everything from self-propelled robots which require standing on a ladder to operate, to inverted hose nozzles which purport to operate from the ground, but afford no way to view the operation, to rope-operated tongs which operate equally blindly, have been proposed and/or marketed with severe limitations in practical effectiveness.

Several US patents show ways of preventing clogs (U.S. Pat. No. 6,497,816 to Naddy and U.S. Pat. No. 6,263,618 to Jones), detecting clogs (U.S. Pat. No. 7,401,571 to Creed), and cleaning clogs (U.S. Pat. No. 4,798,028 to Pinion and U.S. Pat. No. 7,334,369 to Carson).

SUMMARY

It is an object of the present disclosure to provide a gutter system that will enable observation of gutter debris build up, observation of proper flow, and easy cleaning, all from the ground.

It is a further object of the present disclosure to provide a gutter system that will dramatically reduce debris build up.

In accordance with the objectives of the present disclosure, a gutter system for reducing debris buildup is achieved. A waterfall gutter system is provided comprising at least one J-shaped rain gutter configured to be attached to edges of a roof, wherein the attachment and support is exclusively at the underside of the gutter, and a funnel is independently attachable at its lower end to a top end of a downspout wherein there is a vertical gap between the top of the funnel and an end of the gutter wherein water can be seen to flow or not flow from the end of the gutter into the top of the funnel from a position of a person standing at ground level.

Also, in accordance with the objectives of the present disclosure, the funnel of the waterfall gutter system has a front panel, a back panel, and two side panels. The front panel forms a door comprising a panel having a c-shape viewed from a top edge wherein the top edge forms a vertical portion of the c-shape and horizontal portions of the c-shape are parallel to the side panels of the funnel. A hinge attaches the door to the funnel at a bottom edge of the door. A metal strip is embedded in the horizontal portions which in concert with magnets embedded in the side panels hold the door in a closed position. A flange with a push/pull opening is located on an outer surface of the door.

Also in accordance with the objectives of the present disclosure, a method for clearing debris from a gutter system is achieved. A waterfall gutter system is provided comprising at least one J-shaped rain gutter configured to be attached to edges of a roof, wherein the attachment and support is exclusively at the underside of the gutter, and a funnel is independently attachable at its lower end to the top end of a downspout wherein there is a vertical gap between the top of the funnel and an end of the gutter and wherein the funnel has a front panel, a back panel, and two side panels. The front panel forms a door comprising a panel having a c-shape viewed from a top edge wherein the top edge forms a vertical portion of the c-shape and horizontal portions of the c-shape are parallel to the side panels of the funnel. A hinge attaches the door to the funnel at a bottom edge of the door. A metal strip embedded in the horizontal portions in concert with magnets embedded in the side panels hold the door in a closed position. A flange having a push/pull opening is located on an outer surface of the door. Pushing the flange causes the magnets to release and the door to swing inward on its hinge to a first open position wherein the first open position of the door blocks the opening of the funnel to the downspout. Thereafter, debris is pushed out of the rain gutter using a telescoping pole with a dual cleaning pad near its distal end wherein the debris slides along the door and drops to the ground. Thereafter, pulling on the flange causes the door to return to its closed position wherein the magnets keep the door in the closed position. With the door in the closed position, pulling the flange causes the magnets to release and the door to swing outward on the hinge to a second open position exposing the opening of the funnel. Thereafter, debris is pulled out of the funnel opening using a hook on the distal end of the pole.

Also in accordance with the objectives of the present disclosure, a waterfall gutter system is achieved. The waterfall gutter system comprises at least one J-shaped rain gutter configured to be attached to edges of a roof wherein the support and attachment is exclusively from the underside of the gutter and a funnel is independently attachable at its lower end to a top end of a downspout.

Also in accordance with the objectives of the present disclosure, a cleaning pole for removing debris from a gutter system is achieved. The pole comprises a pulling and pushing hook on a distal end and a dual-cleaning pad near the distal end for wiping out debris from a rain gutter.

BRIEF DESCRIPTION OF THE DRAWINGS

In the accompanying drawings forming a material part of this description, there is shown:

FIG. 1 illustrates a perspective view of a preferred embodiment of the present disclosure.

FIG. 1A illustrates a perspective view of an opposite side of a portion of the preferred embodiment of the present disclosure illustrated in FIG. 1.

FIG. 2 illustrates a top view of a portion of a gutter in the preferred embodiment of the present disclosure.

DETAILED DESCRIPTION

Figure 3:
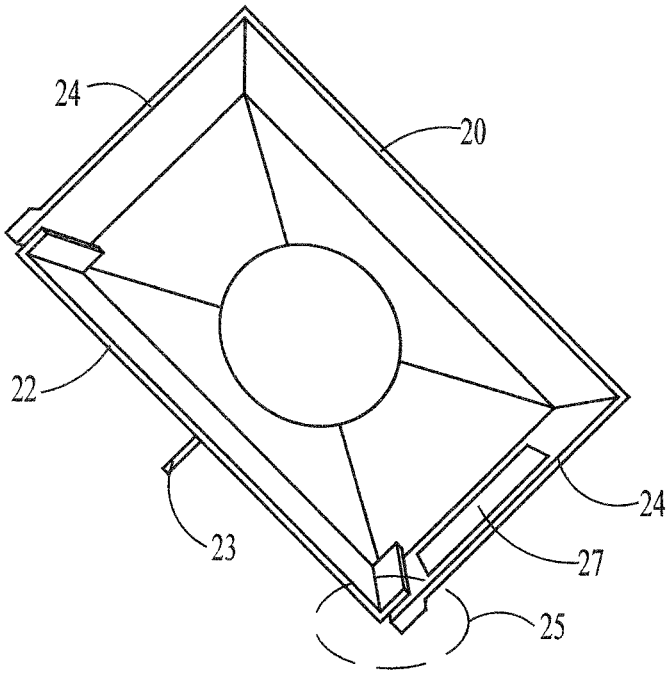
FIG. 3 illustrates a top view of a funnel in the preferred embodiment of the present disclosure.

The present disclosure describes a gutter system that will enable observation of gutter debris build up, observation of proper flow, and easy cleaning, all from the ground. The waterfall gutter system of the present disclosure has the elements to revolutionize conventional gutter systems by making major changes in the way rainwater is handled, eliminating the most common and cumbersome problems relating to debris build up. The simplicity of the design is its hallmark. The key elements are:

Clogging Reduction

Observation Improvement

Resolution Improvement

The gutter system will minimize any opportunity for clogging in the first place by creating a more open water path than previous designs. Water does not need to change flow direction at the traditional 90 degree angle in the design of the present disclosure; rather, it can flow freely off the gutter end in a natural arc. This action alone will have an immense impact on reducing blockages at the most common spot: the downspout. The falling water will dislocate and dislodge any accumulating debris in the funnel portion far better than conventional designs by virtue of its much greater inertial impact. Related to this, freedom from the traditional wall at the very end of the gutter channel will enhance flow throughout the whole channel length and facilitate constant debris removal. The half-round gutter channel design will further enhance water and debris flow by eliminating conventional "K" gutter angled sides/bottoms as catching surfaces.

The gutter system of the present disclosure will enable one to know the precise condition of debris build up, from the ground. An optional infused see-through vein along the bottom of the entire gutter channel will show if debris is building and where it is. Optional see-through funnel sides will allow visual inspection of the downspout collection area, the part most likely to clog, readily from the ground. In operation, the waterfall itself will be a constant and excellent visual confirmation of the conditions in the gutter. Optional see-through panels on the downspout elbows will enable further observation of debris, if any.

The waterfall gutter system of the disclosure will enable a person to realistically, easily, safely and quickly clean or clear any part of a gutter system from the ground. Since the system is supported from the bottom, there are no obstructions along the top side of the gutters, which is integral to the clearing process. For removing debris in the gutter channels, the funnel door is pushed inward using the cleaning pole's hook to prevent the downspout from catching debris and to create a sloping downward debris chute. The dual-pad section of the cleaning pole is then dropped into the gutter at any desired point and pushed along sideways until debris is ejected off the end of the channel. For removing debris caught in the funnel itself, the hook of the cleaning pole is used to pull the funnel door open, at which point the hook can be used to pull any stagnant debris out. The door itself contains self-wiping stripping to assure any debris along the seal can be removed with just a few push-pull motions, if it collects.

The waterfall gutter system of the disclosure will be described in more detail with reference to drawing FIGS. 1-6. Referring now more particularly to FIGS. 1 and 2, the horizontal gutter channel 10 is a "J" shaped curved-bottom design with an optional infused transparent strip 13, shown in FIG. 2, on the bottom side to enable viewing of blocked light (i.e. debris). The strip is just large enough to show or not show light. For example, the gutter 10 may be made of 3/16" solid color PVC (polyvinyl chloride) and the strip 13 may be made of clear 3/16" PVC and have a width of about ½". All supporting is done from the bottom side of the gutter to eliminate any obstructions across the top. Thus all mounting brackets 50 are positioned at the underside of the gutter.

FIG. 1 also shows roof 1 with fascia 2. The brackets 50 will attach at one end to the fascia and the gutter will snap into the bracket. Other types of brackets, not shown, could also be used. The key point is that the brackets hold the gutter from below and do not obstruct the top or the inside of the gutter.

FIG. 2 illustrates the shape of the rain gutter 10. The shape of the gutter is almost half round with the side 11 against the fascia elevated about ½" over the opposite side 12 to form the very slight "J shape." This will bias any water spillage away from the fascia, and away from the house, reducing the chances of water damage.

Water 15 exiting the gutter pours freely over the gutter end 16 into a rectangular funnel 20. The funnel is located preferably about 4 inches below the gutter end 16, for example, thus proper operation can be seen from the ground. That is, because of the vertical gap between the top of the funnel and the end of the gutter, the stream of water 15 can be seen exiting the gutter and entering the funnel. The funnel 20 feeds into the downspout 30. The downspout will have a curve or elbow joint 32 at the top toward the house as in a conventional gutter system. FIG. 1A illustrates the opposite side of the elbow portion 32 of the downspout 30.

The funnel can be located 0 to 12 inches below the gutter end 16. It might be preferable in some cases for the funnel to be touching the gutter end. The funnel water collector will be mounted independently with substantial support. Multiple mounting options will be available in the final product, but the most common will be a simple flat plate 40, as shown for example in FIG. 1, mounted to the fascia 2, with pre-threaded holes to allow elevation variation. The mounting plate 40 also serves as a splash blocker in case of high winds.

Preferably, the downspout 30 should be made of round tubular heavy gauge PVC and should have a diameter of at least 3.5 inches. The large diameter and tubular shape of the downspout will greatly decrease the likelihood of blockage.

Figure 4:
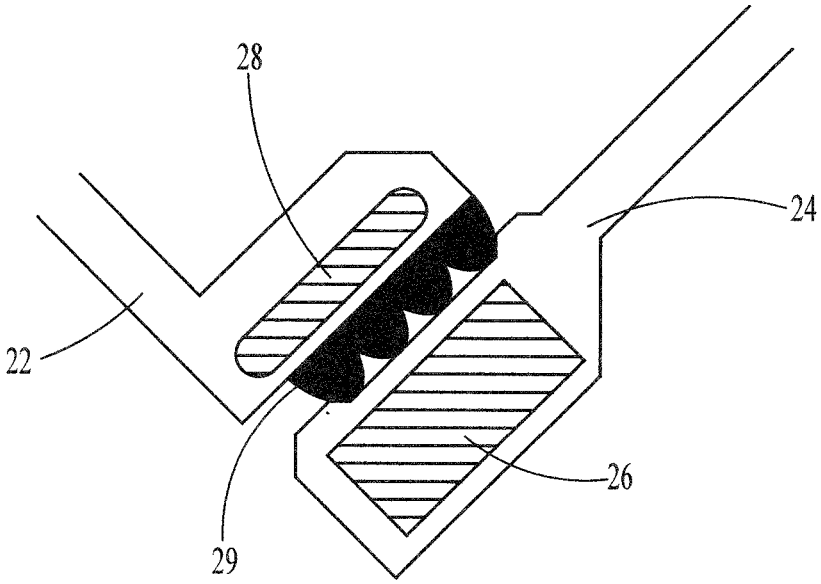
FIG. 4 illustrates a top view detail of a door in the funnel of FIG. 3 in the preferred embodiment of the present disclosure.
Figure 5A:
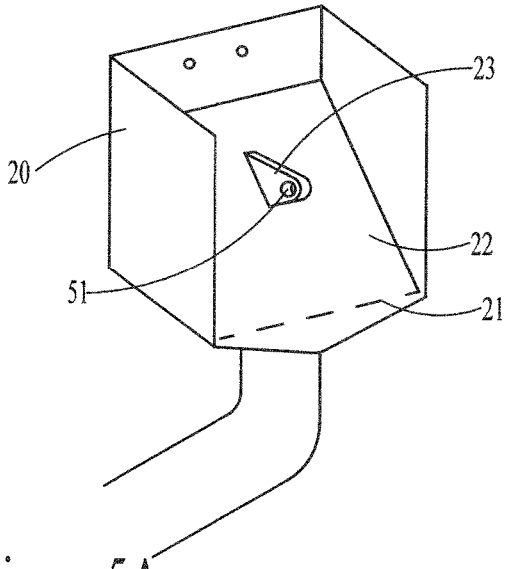
FIG. 5A illustrates a perspective view of the funnel door of the present disclosure in the gutter cleaning position.
Figure 5B:
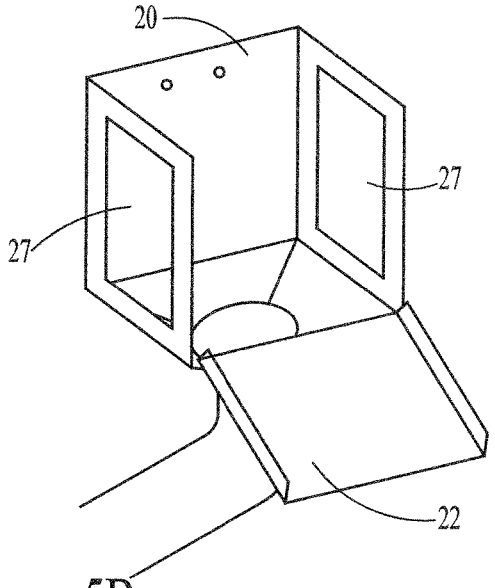
FIG. 5B illustrates a perspective view of the funnel door of the present disclosure in the funnel cleaning position.
Figure 6:
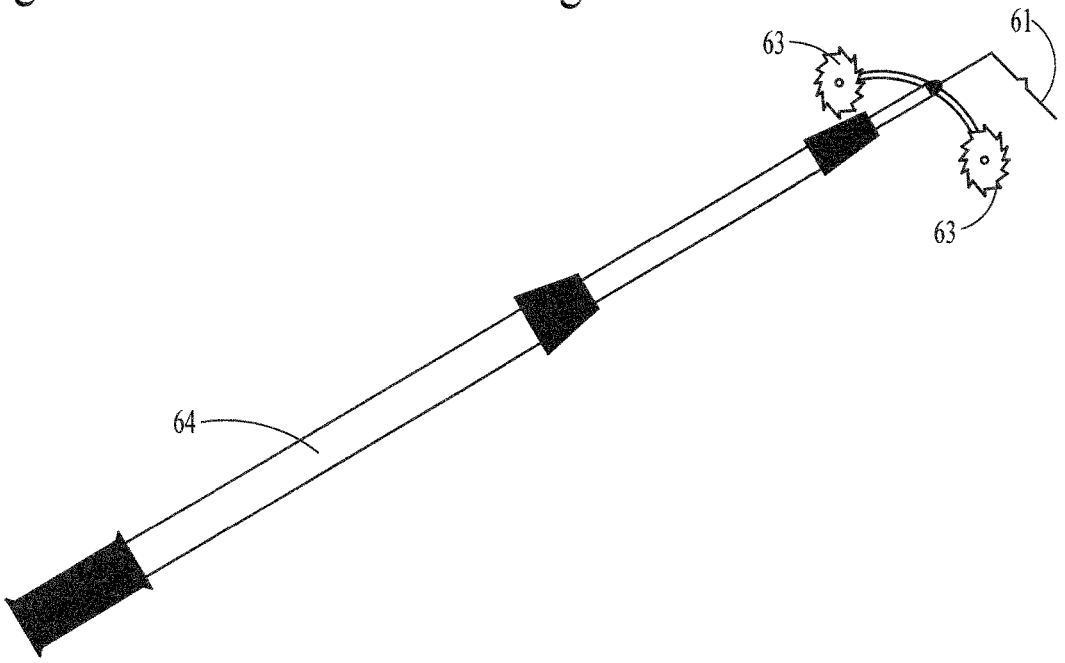
FIG. 6 illustrates a perspective view of a cleaning pole in the preferred embodiment of the present disclosure.

Referring now to FIGS. 3-5, the funnel will be described in more detail. The funnel 20 is preferably made of PVC. One side 22 of the funnel can swing inward or outward, on a sealed hinge 21, as pushed or pulled by a pole with a hook (FIG. 6). The hook 61 makes physical connection with the funnel door 22 at the flange 23 with push/pull opening 51 (see FIG. 5A). An inward swing, shown in FIG. 5A, blocks the downspout and creates a chute, facilitating cleaning from the ground. An outward swing, shown in FIG. 5B, enables cleaning of the funnel itself, if needed.

The swinging door panel 22 is held in the normal closed position of FIG. 3 using neodymium magnets, for example. FIG. 4 shows a close-up view of corner 25 in FIG. 3. Magnets 26 are embedded in the side panels 24 of the funnel. A metal strip 28 is embedded along the edges of the door 22. A seal is created with flexible stripping 29, which is also self-wiping when the panel 22 is opened and/or closed. It will be important for sealing purposes and retaining the whole funnel shape (not distorting over time) to have magnetically forced alignment all the way up and down the funnel sides. Thus, the magnet 26 and metal strip 28 are embedded along the entire height of the side panels and door, respectively.

Both sides of the funnel are optionally see-through. Four specific window options are to be offered for cost and architectural reasons: 1) No windows (as shown in FIG. 5A) 2) Left Window (as shown in FIG. 1) 3) Right Window (as shown in FIG. 3) 4) Left and Right Windows (as shown in FIG. 5B).

Cleaning the gutter is simply a matter of opening the swing panel on the funnel inwardly to cover the downspout and create a downward chute (FIG. 5A), dropping a dual cleaning pad 63 (FIG. 6) mounted at the end of a telescoping pole 64 at any desired point in the channel 10, and sliding debris out sideways with minimal lateral pressure until it drops off the end of the gutter onto the door/chute, and from there, onto the ground.

A second (lower cost) waterfall gutter system is proposed which will not have the transparent viewing features.

The first bend 32 in the tubular downspout 30 going down should be the most extreme, but soft enough in curvature to allow passage of debris and twigs, estimated at about 75 degrees, for example. In the unlikely event of debris getting caught, this assures the only place it could happen is next to the funnel where it could be most easily reached and cleaned out. Optionally, a pair of opposed small clear windows 33, 34 (seen in FIGS. 1 and 1A) can be located at the top bend 32, making the entire system fully viewable for debris buildup.

FIG. 6 shows an example of a simple, adjustable length pole for gutter cleaning and for opening/closing the door in the funnel. The hook 61 will have a modest "V" bend in it to allow for some captivity when opening and closing as well as to aid in cleaning away branches or twigs. The telescoping pole 64 should be lightweight, adjustable up to about 21 feet, for example, and made of fiberglass, for example. Dual cleaning pads 63 are shown. For example, a flat aluminum strap having plastic spherical ends with replaceable elastic microfiber covers form the cleaning pads.

Cleaning the gutter begins with inserting the hook 61 on the pole 64 into the opening 51 in the funnel door flange 23 and pushing. This opens the funnel door inwardly, positioning it over the funnel opening and creating a chute, as shown in FIG. 5A. Then, the dual cleaning pads 63 are dropped at any desired point into the channel 10. Lateral pressure is applied on the pole to slide debris sideways until it drops off the end of the channel, onto the chute 22, and then onto the ground. The hook is used a second time to pull up on the flange 23, returning the door to its normal closed position, as shown in FIG. 3.

If it is necessary to clean out the funnel, the hook 61 on the pole 64 is inserted into the opening 51 in the funnel door flange 23, and the door is pulled to open the funnel door outwardly, as shown in FIG. 5B. Then, the hook 61 is inserted into the funnel opening to pull out any debris that has built up in the funnel. The hook is used again to push on the flange to return the door to its normal closed position.

The swinging funnel door is an option. If there are few trees, the expected smaller volume of debris may pass readily through the system, and it might not be necessary to block the funnel opening during cleaning of the gutter. Removing the swinging funnel door would reduce the cost of the gutter system.

Although the preferred embodiment of the present disclosure has been illustrated, and that form has been described in detail, it will be readily understood by those skilled in the art that various modifications may be made therein without departing from the spirit of the disclosure or from the scope of the appended claims.

What is claimed is:

1. A waterfall gutter system comprising:

at least one J-shaped rain gutter configured to be attached to an edge of a roof wherein mounting hardware to attach and support said rain gutter to said roof is located at an underside of said gutter and wherein at least one end of said gutter is open; and a funnel having a lower end which is independently attachable to a top end of a downspout configured so that after installation, a vertical open air gap exists between a top of said funnel and an open end of said gutter, and having an upper end open to air, wherein said funnel has a front panel, a back panel, and two side panels, wherein the back panel of said funnel is configured to be independently attached to a roof; and wherein said front panel forms a door comprising a hinge attaching said door to said funnel at a bottom edge of said door wherein when said door is pushed, said door swings inward on said hinge to a first open position and when said door is pulled, said door swings outward on said hinge to a second open position and wherein when said door is in a normal position, water flows from said open end of said gutter over said vertical open air gape into said open upper end of said funnel, and through said downspout;

wherein at least one uninterrupted horizontal plane exists between a vertical plane tangential to an outer portion of a first side of the gutter and vertical plane tangential to an outer portion of a second side of the gutter, wherein the at least one uninterrupted horizontal plane is between a lowest point of the gutter and a highest point of the funnel;

wherein the downspout is horizontally offset from the open end of the gutter in a direction of water flow such that a horizontal gap exists between the downspout and the open end of the gutter.

2. The waterfall gutter system of claim 1 wherein said front panel further comprises:

a panel having a c-shape viewed from a top edge wherein said top edge forms a vertical portion of said c-shape and horizontal portions of said c-shape are parallel to said side panels of said funnel;

a metal strip embedded in said horizontal portions of said panel that in concert with magnets embedded in said side panels hold said door in a closed position; and a flange with a push/pull opening on an outer surface of said door that when pushed causes said magnets to release and said door to swing inward on said hinge to said first open position and when pulled causes said magnets to release and said door to swing outward on said hinge to said second open position.

3. The waterfall gutter system of claim 1 wherein one or two of said side panels are transparent.

4. The waterfall gutter system of claim 2 further comprising self-wiping stripping on said horizontal portions of said c-shape to remove debris along said side panels.

5. The waterfall gutter system of claim 1 wherein said at least one rain gutter comprises an infused transparent vein along a bottom surface of said rain gutter providing a view of any debris in said rain gutter from said position of a person standing at ground level.

6. The waterfall gutter system of claim 1 further comprising opposing transparent panels on an elbow joint of said downspout.

7. The waterfall gutter system of claim 1 wherein said vertical open air gap is at least 4".

8. The waterfall gutter system of claim 1 wherein a diameter of said downspout is at least 3.5".

9. The waterfall gutter system of claim 2 wherein said magnets comprise neodymium.

10. The waterfall gutter system of claim 1 wherein a taller side of said J-shaped rain gutter abuts said edge of said roof.

11. A waterfall gutter system comprising:

at least one J-shaped rain gutter configured to be attached to an edge of a roof wherein mounting hardware to attach and support said rain gutter to said roof is located at an underside of said gutter and wherein at least one end of said gutter is open; and a funnel having a lower end which is independently attachable to a top end of a downspout, wherein the downspout is located a horizontal open air gap away from said open end of said gutter, and having an upper end open to air, wherein said funnel has a front panel, a back panel, and two side panels wherein the back panel of said funnel is configured to be independently attached to a roof and;

wherein said front panel forms a door comprising a hinge attaching said door to said funnel at a bottom edge of said door wherein when said door is pushed, said door swings inward on said hinge to a first open position and when said door is pulled, said door swings outward on said hinge to a second open position and wherein when said door is in a normal position, water flows from said open end of said gutter into said open top end of said funnel, and through said downspout;

wherein at least one uninterrupted horizontal plane exists between a vertical plane tangential to an outer portion of a first side of the gutter and vertical plane tangential to an outer portion of a second side of the gutter wherein the at least one uninterrupted horizontal plane is between a lowest point of the gutter and a highest point of the funnel.

12. The waterfall gutter system of claim 11 wherein said front panel further comprises a panel having a c-shape viewed from a top edge wherein said top edge forms a vertical portion of said c-shape and horizontal portions of said c-shape are parallel to said side panels of said funnel;

a metal strip embedded in said horizontal portions of said panel that in concert with magnets embedded in said side panels hold said door in a closed position; and a flange with a push/pull opening on an outer surface of said door that when pushed causes said magnets to release and said door to swing inward on said binge to said first open position and when pulled causes said magnets to release and said door to swing outward on said hinge to said second open position.

13. The waterfall gutter system of claim 11 wherein said one or two of said side panels are transparent.

14. The waterfall gutter system of claim 12 further comprising self-wiping stripping on said horizontal portions of said c-shape to remove debris along said side panels.

15. The waterfall gutter system of claim 11 wherein said at least one rain gutter comprises an infused transparent vein along a bottom surface of said rain gutter providing a view of any debris in said rain gutter from said position of a person standing at ground level.

16. The waterfall gutter system of claim 11 further comprising opposing transparent panels on an elbow joint of said downspout.

17. The waterfall gutter system of claim 11 wherein after installation, there is a vertical open air gap between a top of said funnel and an end of said gutter wherein said vertical open air gap is at least 4".

18. The waterfall gutter system of claim 11 wherein a taller side of said J-shaped rain gutter abuts said edge of said roof.

* * * * *